US008107851B2

(12) United States Patent
Tamura et al.

(10) Patent No.: US 8,107,851 B2
(45) Date of Patent: Jan. 31, 2012

(54) IMAGE FORMING APPARATUS PROVIDED WITH IMAGE READING UNIT

(75) Inventors: Takashi Tamura, Osaka (JP); Masuo Kawamoto, Osaka (JP); Hiroshi Ito, Osaka (JP)

(73) Assignee: Kyocera Mita Corporation (JP)

( * ) Notice: Subject to any disclaimer, the term of this patent is extended or adjusted under 35 U.S.C. 154(b) by 608 days.

(21) Appl. No.: 12/330,626

(22) Filed: Dec. 9, 2008

(65) Prior Publication Data

US 2009/0148179 A1 Jun. 11, 2009

(30) Foreign Application Priority Data

Dec. 10, 2007 (JP) ..... 2007-318261
Dec. 10, 2007 (JP) ..... 2007-318263

(51) Int. Cl.
*G03G 15/00* (2006.01)

(52) U.S. Cl. ..... 399/107; 399/144

(58) Field of Classification Search ..... 399/144, 399/151, 107; 358/474
See application file for complete search history.

(56) References Cited

U.S. PATENT DOCUMENTS

2005/0219656 A1* 10/2005 Sato ..... 358/498
2006/0114523 A1 6/2006 Ono

FOREIGN PATENT DOCUMENTS

CN 1780351 A 5/2006
JP 2004-61957 2/2004
JP 3526969 2/2004

* cited by examiner

*Primary Examiner* — David Gray
*Assistant Examiner* — Barnabas Fekete
(74) *Attorney, Agent, or Firm* — Gerald E. Hespos; Michael J. Porco

(57) ABSTRACT

An image forming apparatus has a wide first main body, a narrow second main body below the first main body, and a cover on at least on one side of the second main body. The cover includes first and second walls. The first wall connects a side edge of the first main body and a lower side edge of the second main body. The second wall is a substantially inverted triangle that extends obliquely from the front edge of the first wall.

9 Claims, 7 Drawing Sheets

IMAGE FORMING APPARATUS PROVIDED WITH IMAGE READING UNIT

BACKGROUND OF THE INVENTION

1. Field of the Invention

The present invention relates to an image forming apparatus in which an image forming unit for performing a specified image forming process based on image information read by an image reading unit is arranged below the image reading unit for reading the image information of a document.

2. Description of the Related Art

An image forming apparatus is known which includes an apparatus main body provided with an image forming unit, and an image reading unit arranged atop the apparatus main body. Japanese Patent No. 3526969 discloses such an image forming apparatus that handles are provided at positions of the respective left and right walls of the apparatus main body near the front end. By providing such handles, a user can move the image forming apparatus by gripping these handles upon installing the image forming apparatus or relocating the already installed image forming apparatus.

However, the above handles are respectively provided on the vertical side walls of the apparatus main body. Thus, if the image forming apparatus is arranged between a file box and another apparatus, there may be cases where the handles are shielded and cannot be gripped from the outside. Further, if a cover member is provided on the front surface of the apparatus main body, it may be difficult to open and close the cover member or to detach the cover member.

Thus, there has been a problem that operability is poor, for example, when the user relocates the image forming apparatus or when a service person performs a maintenance operation.

SUMMARY OF THE INVENTION

An object of the present invention is to provide an image forming apparatus provided with an image reading unit atop an image forming unit, which apparatus can be easily withdrawn from an installation place even if being installed in a limited space such as the one between neighboring apparatuses.

In order to accomplish this object, one aspect of the present invention is directed to an image forming apparatus, comprising a first main body housing an image reading unit for reading image information of a document; a second main body arranged below the first main body and housing an image forming unit for performing a specified image forming process based on the image information read by the image reading unit; and a first cover mounted on at least one side surface of the second main body, wherein the lateral width of the first main body is set larger than that of the second main body; the first cover includes a first wall surface and a second wall surface; the first wall surface is a wall surface extending along a virtual plane connecting a first edge extending in forward and backward directions at one lateral end of the first main body and a second edge extending in forward and backward directions at one lateral end of the second main body corresponding to the first edge and located at a bottom part of the second main body; and the second wall surface is a wall surface for closing a substantially inverted triangular opening formed between the front edge of the first wall surface and the side surface of the second main body and including an inclined surface portion obliquely extending from the front edge of the first wall surface toward the side surface of the second main body.

These and other objects, features, aspects and advantages of the present invention will become more apparent upon a reading of the following detailed description with reference to accompanying drawings.

BRIEF DESCRIPTION OF THE DRAWINGS

FIGS. 1A and 1B are perspective views showing an image forming apparatus according to one embodiment of the invention, wherein FIG. 1A shows a state where a document pressing member is closed and FIG. 1B shows a state where the document pressing member is opened, FIGS. 7A to 7C are perspective views showing one embodiment of a front cover provided in place of the front frame, wherein FIG. 7A shows a state where a discharge tray and the front cover are closed, FIG. 7B shows a state where the discharge tray and the front cover are opened and FIG. 7C shows a dual gear in a perspective view partly cut out.

DETAILED DESCRIPTION OF THE PREFERRED EMBODIMENTS

Figure 1A:
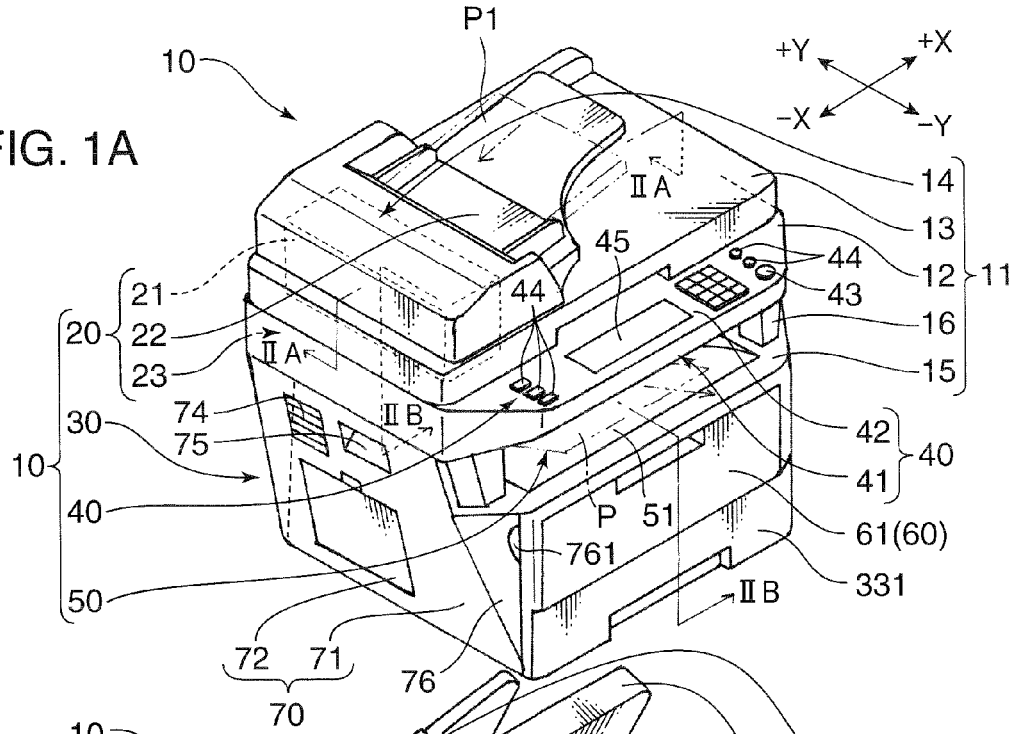
Figure 1B:
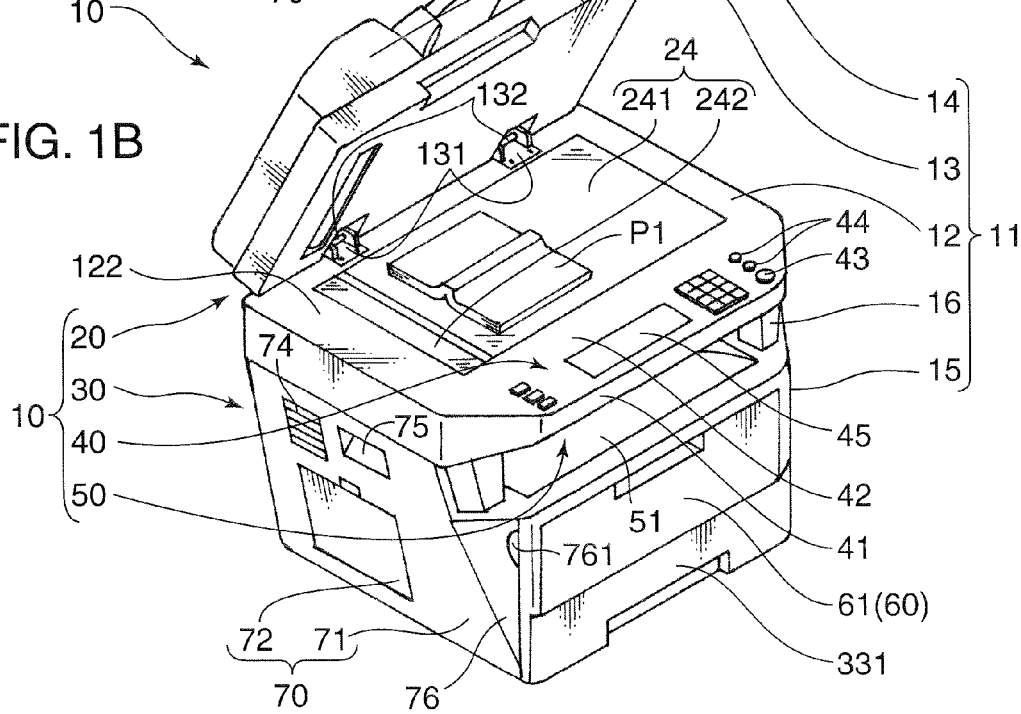
Figure 2A:
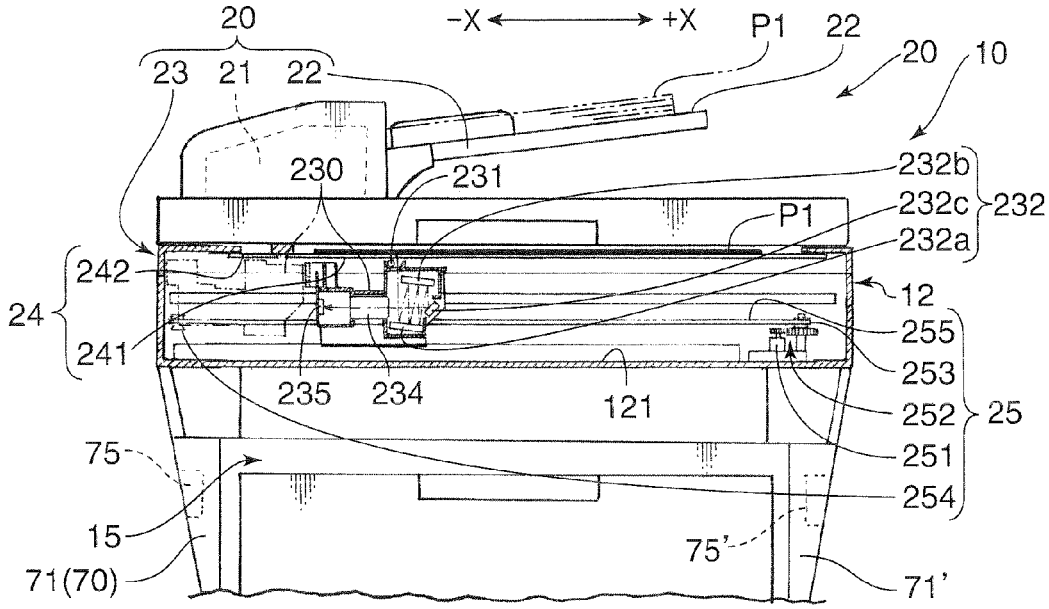
FIGS. 2A and 2B are sections along IIA-IIA and IIB-IIB of FIG. 1A.
Figure 2B:
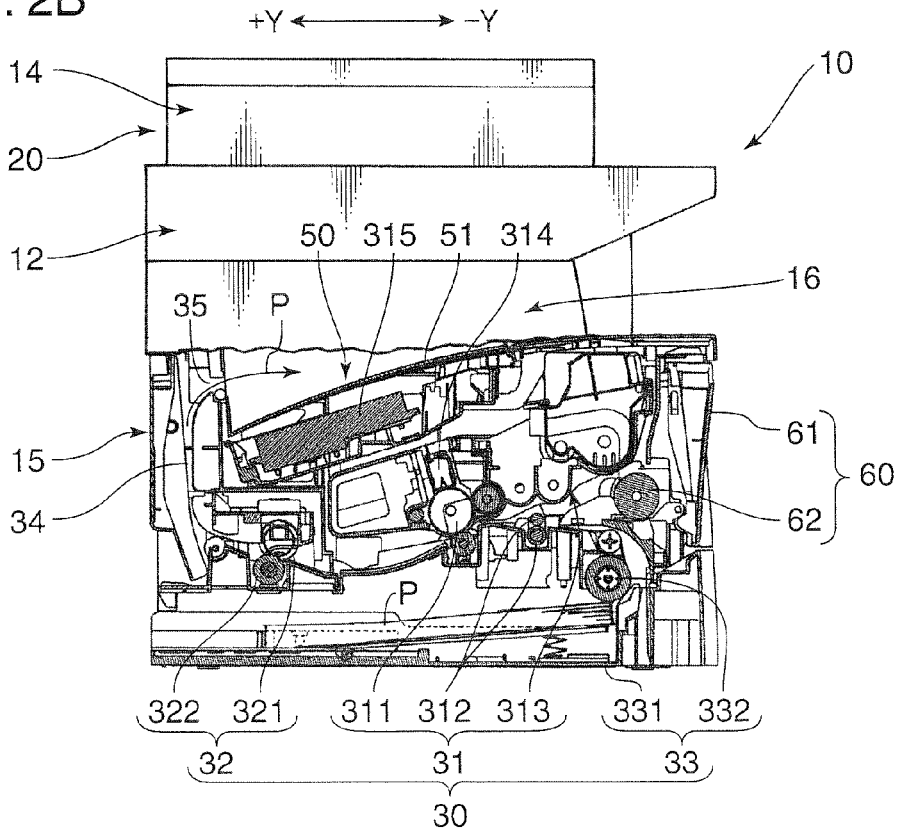

Hereinafter, one embodiment of the present invention is described in detail with reference to the accompanying drawings. FIGS. 1A and 1B are perspective views showing an image forming apparatus 10 according to the embodiment of the invention, wherein FIG. 1A shows a state where a document pressing member 13 is closed and FIG. 1B shows a state where the document pressing member 13 is opened, and FIGS. 2A and 2B are sections along IIA-IIA and IIB-IIB of FIG. 1A. In FIGS. 1A to 2B, X-X directions are referred to as lateral directions and Y-Y directions are referred to as forward and backward directions. Particularly, −X direction is referred to as a leftward direction, +X direction as a rightward direction, −Y direction as a forward direction and +Y direction as a backward direction.

The image forming apparatus 10 is provided with a document reading unit 20 for reading an image formed on a document, an image forming unit 30 arranged below the document reading unit 20, an operation unit 40 projecting forward from a front position of the document reading unit 20 and a sheet discharging unit 50 to which a sheet P having an image forming process performed by the image forming unit 30 is discharged. These units are accommodated in a housing 11.

The housing 11 includes an image reading unit housing 12 (first main body), the document pressing member 13, an automatic document feeding unit housing 14 and an image forming unit housing 15 (second main body). The image reading unit housing 12 is in the form of a flat rectangular parallelepiped and houses an optical unit 23 as a constituent element of the document reading unit 20. The document pressing member 13 is openably and closably placed atop the image reading unit housing 12. The automatic document feeding unit housing 14 is arranged on the document pressing member 13 and houses an automatic document feeder 21 to be described later. The image forming unit housing 15 is arranged below the image reading unit housing 12 and houses the image forming unit 30. The automatic document feeding unit housing 14 is arranged at a substantially left half position of the document pressing member 13.

Connecting portions 16 are provided between the image reading unit housing 12 and the image forming unit housing 15. The connecting portions 16 respectively stand at the lateral end positions of the image forming unit housing 15 to support the image reading unit housing 12. The sheet discharging unit 50 is formed in a space defined between the automatic document feeding unit housing 14 and the image forming unit housing 15 by the presence of the connecting portions 16. Thus, the image forming apparatus 10 according to this embodiment is called to be of the internal discharging type.

In this embodiment, a conveying direction of a document P1 in the document reading unit 20 and a conveying direction of a sheet P in the image forming unit 30 are set orthogonal to each other. Specifically, as shown by arrows of chain double-dashed line in FIG. 1A, the document P1 is conveyed in a lateral direction, whereas the sheet P is conveyed along forward and backward directions.

This direction setting is made for the following reason. Specifically, when a user places documents P1 on a document tray 22 atop the housing 11, it is preferable to horizontally orient the documents P1 when viewed from the user facing the front side of the image forming unit housing 15 in order for the user to visually confirm a placed state of the documents P1 (particularly a state as to whether or not the leading end of a stack of documents is reliably located at a mount position). On the other hand, in the case of the sheet discharging unit 50 of the internal discharging type, it is convenient to discharge the sheet toward the user since a stack of sheets P can be easily pulled out from the sheet discharging unit 50. In order to satisfy these two conditions, the conveying direction of the document P1 and that of the sheet P are set orthogonal to each other.

The document reading unit 20 includes the automatic document feeder 21, the document tray 22 and the optical unit 23. The automatic document feeder 21 automatically feeds documents to a specified image reading position (automatically fed document glass 242). The document tray 22 is provided to have a stack of documents P1 to be fed by the automatic document feeder 21 placed thereon and extends obliquely upward to the right from a right opening of the automatic document feeder 21. The optical unit 23 optically reads an image of a document, which comes to face contact glasses 24 to be described later.

A large rectangular upper opening is formed in a top panel 122 of the image reading unit housing 12. The contact glasses 24, with which image formation surfaces of documents come into contact, are fitted in the opening of this top panel 122. The contact glasses 24 include a placed document glass 241 substantially covering a central part of the upper surface of the image reading unit housing 12 and the automatically fed document glass 242 arranged immediately to the left of the placed document glass 241 and narrow and long in forward and backward directions.

The document pressing member 13 has the rear edge thereof connected with the upper surface of a rear edge portion of the image reading unit housing 12 via a pair of hinge members 131 spaced apart in the lateral direction. By being rotated in forward and reverse directions about the respective hinge members 132, the document pressing member 13 can be displaced between a closing posture to close the contact glasses 24 (see FIG. 1A) and an exposing posture to expose the contact glasses 24 (see FIG. 1B).

For example, in the case of reading a document image of a thick document P1 such as a book document, the user places this document P1 on the placed document glass 241 such that a document surface is in close contact with the document pressing member 13 opened. Thereafter, an image on the document surface is read by the optical unit 23 with the document pressing member 13 closed.

In contrast, in the case of reading images of documents P1 from a stack of thin documents P1, the user sets the document pressing member 13 in the closing posture (see FIG. 1A) and places the stack of documents on the document tray 22. If a start button 43 is pressed in this state, the documents P1 are fed one by one toward the automatically fed document glass 242 from the stack of documents on the document tray 22 by a specified operation of automatic document feeder 21. When the document surface of the document P1 passes above the automatically fed document glass 242, the document image is read by the optical unit 23.

Next, the optical unit 23 is described with reference to FIG. 2A. The optical unit 23 is of the so-called CCD (charge coupled device) moving type and includes a movable frame 230 movable in the lateral directions, an irradiation lamp 231 housed in this movable frame 230, a plurality of reflection mirrors 232 for further reflecting reflected light of light irradiated by the irradiation lamp 231 from the document surface, a lens unit 234 for condensing the reflected light from the reflection mirrors 232 to adjust a focal length, and a CCD image sensor 235 for converting image information represented by the incident light from the lens unit 234 into an electrical signal. The irradiation lamp 231 is arranged at an upper position slightly closer to the right side than a lateral center position in the movable frame 230.

The reflection mirrors 232 are arranged at right half positions in the movable frame 230 and include three mirrors of a first mirror 232*a*, a second mirror 232*b* and a third mirror 232*c*. The first mirror 232*a* first receives the reflected light of the light irradiated by the irradiation lamp 231 from the document P1 and reflects it. The second mirror 232*b* receives the reflected light of the first mirror 232*a* and further reflects it. The third mirror 232*c* further reflects the reflected light from the second mirror 232*b* such that the reflected light is incident on the lens unit 234. The third mirror 232*c* is formed by a concave mirror and the lens unit 234 is arranged at a focus position thereof.

The lens unit 234 is arranged at a substantially widthwise center position in the movable frame 230. The CCD image sensor 235 is arranged at a substantially center position of the movable frame 230 and immediately to the left of the lens unit 234. The light condensed by the lens unit 234 is directly irradiated to the CCD image sensor 235. The CCD image sensor 235, on which the light from the lens unit 234 was incident, converts this light into an analog electrical signal corresponding to its intensity. This analog electrical signal is digitized and is outputted to an exposure device 315 of the image forming unit 30 via a specified memory device.

The optical unit 23 includes a moving mechanism 25 for moving the movable frame 230. The moving mechanism 25 includes a drive motor 251 mounted at the right end of a bottom plate 121 in the image reading unit housing 12, a gear mechanism 252 for transmitting a driving force of the drive motor 251 in a decelerated state, a drive pulley 253 to which the driving force of the drive motor 251 is transmitted via the gear mechanism 252, a driven pulley 254 arranged at a left end position of the bottom plate 121 to face the drive pulley 253 and a scanner belt 255 mounted between the driven pulley 254 and the drive pulley 253. A part of the scanner belt 255 is fixed to a specified position of the movable frame 230.

According to such a moving mechanism 25, the driving force is transmitted to the drive pulley 253 in a decelerated state via the gear mechanism 252 by driving the drive motor 251 in forward and reverse directions. In this way, the scanner belt 255 turns between the drive pulley 253 and the driven pulley 254 and the optical unit 23 fixed to the scanner belt 255 is moved in forward and reverse directions.

Accordingly, upon reading the document surface of the document P1 placed on the placed document glass 241 by the user, the image of the document P1 on the placed document glass 241 is scanned by light from the irradiation lamp 231 while the movable frame 230 is moved rightward from a left end position (home position) in the image reading unit housing 12 by the turning movement of the scanner belt 255. Reflected light by this scanning is inputted to the CCD image sensor 235 via the reflection mirrors 232 and the lens unit 234 to have the document image read.

On the other hand, in the case of reading images of the respective documents P1 by dispensing the documents P1 one by one from a stack of the documents P1 placed on the document tray 22, the movable frame 230 is kept stationary at the home position. In this state, the automatic document feeder 21 is driven to dispense the documents P1 one by one from the stack of the documents and the irradiation lamp 231 is turned on in synchronism with a timing at which the document surface of the document P1 faces the automatically fed document glass 242. Reflected lights from the document surfaces when the document surfaces successively pass the automatically fed document glass 242 are read by the CCD image sensor 235.

Next, with reference to FIG. 2B, the image forming unit 30 is outlined. The image forming unit 30 includes a transfer device 31 for transferring a document image read by the image reading unit 20 in the form of a toner image to a sheet, a fixing device 32 for fixing the toner image on the sheet transferred in the transfer device 31, a sheet storing portion 33 for storing sheets to be fed toward the transfer device 31, a charger 314 and the exposure device 315. These constituent elements are housed in the box-shaped image forming unit housing 15.

The transfer device 31 includes a photoconductive drum 311 for successively forming an electrostatic latent image and a toner image on the circumferential surface thereof, a pair of registration rollers 312 for feeding a sheet to the circumferential surface of the photoconductive drum 311 at a specified timing, and a developing device 313 for supplying toner to the circumferential surface of the photoconductive drum 311.

The charger 314 uniformly charges the circumferential surface of the photoconductive drum 311. The exposure device 315 irradiates the circumferential surface of the photoconductive drum 311 with a laser beam based on the image information of the document read by the scanning in the optical unit 23 and stored in the memory device. The photoconductive drum 311 is uniformly charged by the charger 314 while being rotated about its axial center and, then, laser beams are irradiated from the exposure device 315 to successively form electrostatic latent images on the circumferential surface of the photoconductive drum 311. The toner is supplied to the electrostatic latent image from the developing device 313 to form a toner image on the circumferential surface of the photoconductive drum 311. The toner image on the circumferential surface of the photoconductive drum 311 is transferred to a sheet P fed via the pair of registration rollers 312.

The fixing device 32 applies a fixing process to the sheet P having the toner image transferred thereto in the transfer device 31. Such a fixing device 32 includes a fixing roller 321 accommodating an electric heating element such as a halogen lamp therein and a pressure roller 322 arranged to face the fixing roller 321 from below.

The sheet P conveyed from the transfer device 31 by the rotation of the photoconductive drum 311 is fed to between the fixing roller 321 and the pressure roller 322. By being heated by the fixing roller 321, the toner image is fixed to the sheet P. The sheet P having passed the fixing device 32 passes a conveyance path 34 provided at a most downstream end and is discharged to the sheet discharging unit 50 through a discharge port 35.

The sheet storing portion 33 includes a sheet cassette 331 detachably mountable into the image forming unit housing 15 and a pickup roller 332 disposed in correspondence with one end (front end in an example shown in FIG. 2B) of the sheet cassette 331. Uppermost ones of a stack of sheets P stored in the sheet cassette 331 are successively dispensed by the rotation of this pickup roller 332 to be fed toward the transfer device 31.

The sheet P1 dispensed from the sheet cassette 331 has a toner image on the circumferential surface of the photoconductive drum 311 transferred thereto while being conveyed via the pair of registration rollers 312. Subsequently, the sheet P is discharged along the conveyance path 34 to a discharge tray 51 of the sheet discharging unit 50 through the discharge port 35 after a thermal fixing process by the fixing roller 321 is applied thereto in the fixing device 32.

A manual sheet feeder 60 is provided at a position of the front surface of the image forming unit housing 15. This manual sheet feeder 60 includes an openable and closable manual feed tray 61 and a pickup roller 62 for dispensing a sheet P placed on the manual feed tray 61 in an open state to feed it toward the transfer device 31.

As shown in FIGS. 1A and 1B, the operation unit 40 includes an operation unit housing 41 formed by a forward projecting part of the image reading unit housing 12, and an operation panel 42 formed on the upper surface of this operation unit housing 41. On the operation panel 42 are provided the start button 43, various operation buttons 44, a display 45 which is an LCD (liquid crystal display) for displaying various pieces of image formation information on a screen and the like. The user causes the image forming apparatus 10 to perform a specific image forming process by operating and watching these operating members.

Figure 3:
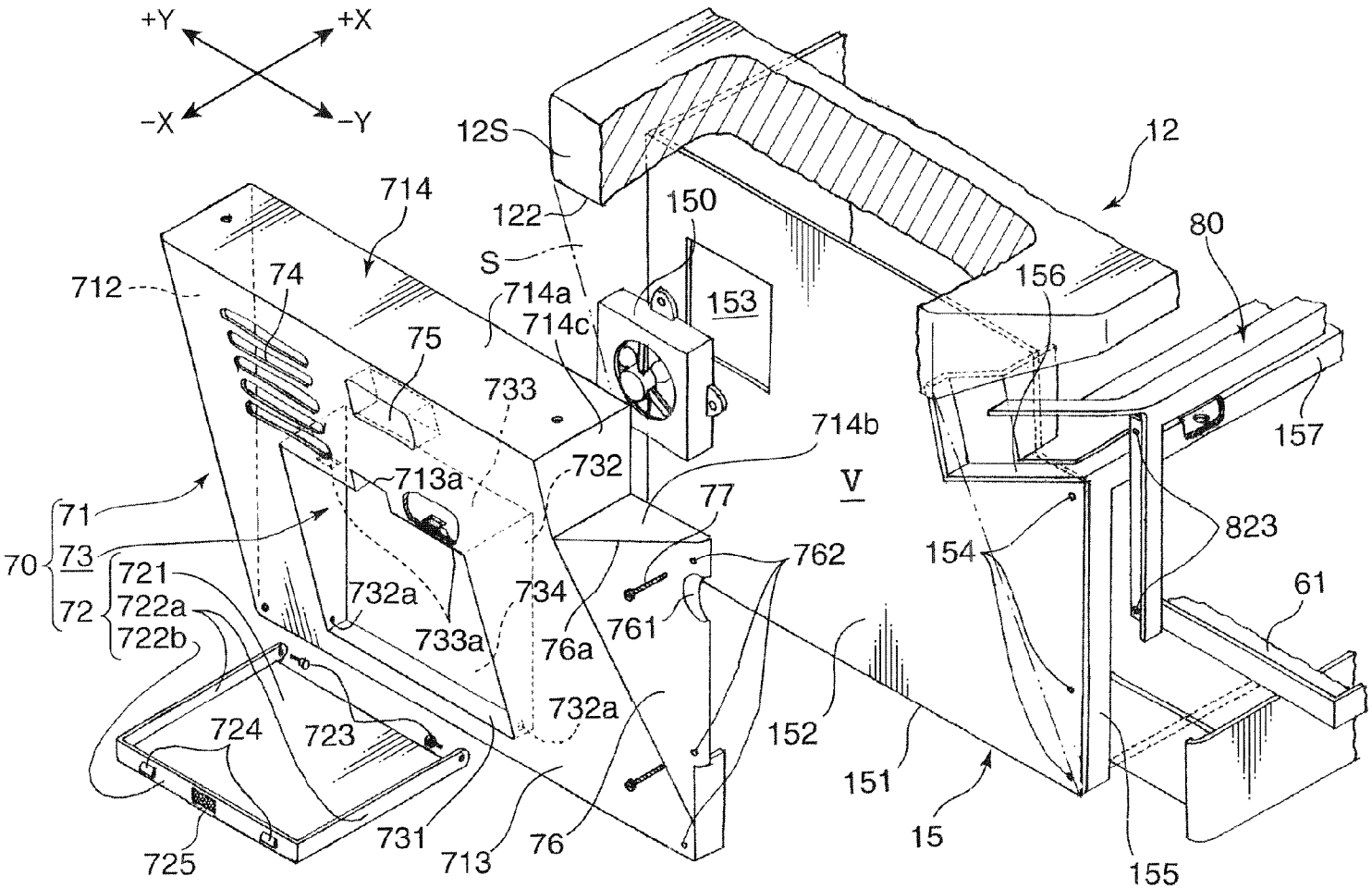
FIG. 3 is an exploded perspective view showing one embodiment of a storage structure.
Figure 4:
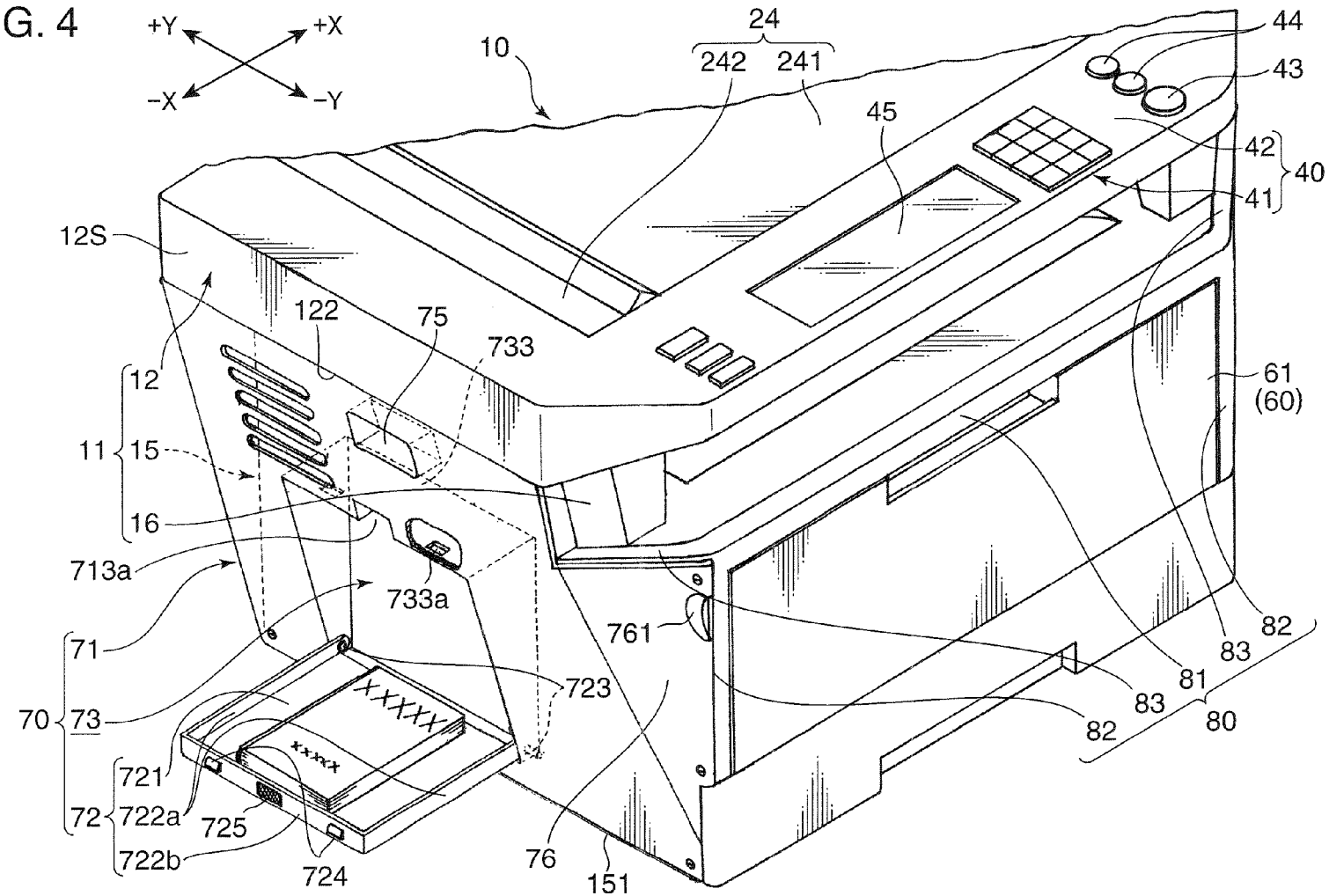
FIG. 4 is an assembled perspective view of the storage structure shown in FIG. 3.
Figure 5:
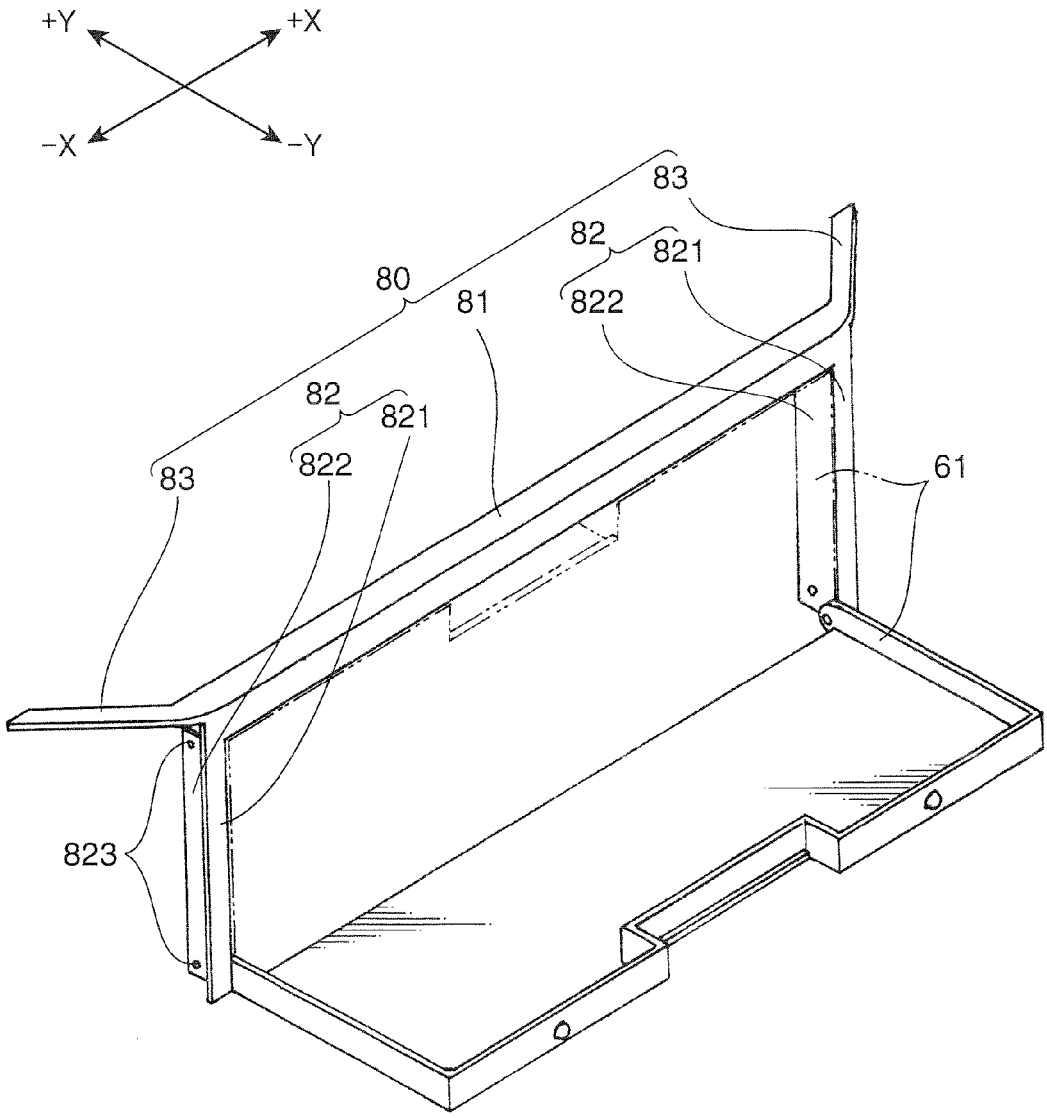
FIG. 5 is a perspective view showing a front frame.

A storage structure 70, a front inverted triangular wall 76 (inclined surface portion) and a front frame 80 are described below with reference to FIGS. 3 to 5 and, if necessary, also FIGS. 1 and 2. FIGS. 3 and 4 are perspective views showing one embodiment of the storage structure 70, wherein FIG. 3 is an exploded perspective view and FIG. 4 is an assembled perspective view. FIG. 5 is a perspective view showing one embodiment of the front frame 80. The indication of directions by X and Y in FIGS. 3 to 5 are the same as in the case shown in FIGS. 1 (X-X are lateral directions (−X: leftward direction, +X: rightward direction) and Y-Y are forward and backward directions (−Y: forward direction, +Y: backward direction).

As shown in FIG. 2A, the storage structure 70 according to this embodiment is formed utilizing the fact that the lateral width of the image reading unit housing 12 is larger than that of the image forming unit housing 15. In other words, if the lateral dimension of the image reading unit housing 12 is larger than that of the image forming unit housing 15, side surfaces 12S of the image reading unit housing 12 are located more outward than the left and right surfaces (only the left surface is shown in FIG. 3) of the image forming unit housing 15 as shown in FIG. 3 with a central part of the image reading unit housing 12 placed on the upper surface of the image forming unit housing 15.

Accordingly, excess spaces V where goods can be properly stored without interfering with others can be formed at inner sides of virtual planes (flat planes or curved planes) S connecting first bottom edges 122 (first edges) of the side surfaces 12S and second bottom edges 151 (second edges) extending in forward and backward directions from the left and right ends of the bottom end of the image forming unit housing 15. In this embodiment, the storage structure 70 capable of storing various goods is formed, utilizing such an excess space V.

The storage structure 70 is so mounted as to substantially cover the excess space V on a left frame plate 152 of the image forming unit housing 15 and includes a covering body 71 (first cover) having an outer wall surface extending along the virtual plane S and a storage door 72 openably and closably mounted on this covering body 71.

The covering body 71 includes a front inverted triangular wall 76 (second wall surface) having an inverted triangular shape, a rear inverted triangular wall 712 (third wall surface) facing the front inverted triangular wall 76 at a rear side, a left wall 713 (first wall surface) as a wall surface bridging between the left edges of these front and rear inverted triangular walls 76, 712 and extending along the virtual plane S, and a ceiling wall 714 bridging between the upper edges of the inverted triangular walls 76, 712. A covering member 71' (see FIG. 2A) similar to the covering member 71 is provided on the right surface of the image forming unit housing 15. No storage section is defined in this covering body 71' and, hence, no storage door 72 is provided.

The left wall 713 is a flat wall surface present to bridge between the first bottom edge 122 and the second bottom edge 151. When viewed from front, the left wall 713 is so inclined as to be gradually distanced from the left frame plate 152 of the image forming unit housing 15 (side surface of the second main body) from the bottom end toward the top end of the left wall 713.

The front inverted triangular wall 76 is a wall surface for closing a substantially inverted triangular opening formed between the front edge of the left wall 713 and the left frame plate 152. Further, the rear inverted triangular wall 712 is a wall surface for closing a substantially inverted triangular opening formed between the rear edge of the left wall 713 and the left frame plate 152.

The rear inverted triangular wall 712 is a wall surface at 90° to the left wall 713. In other words, the rear inverted triangular wall 712 is a laterally extending wall surface perpendicular to the left frame plate 152.

The front inverted triangular wall 76 is an inclined surface obliquely extending from the front edge of the left wall 713 toward the left frame plate 152 and has a substantially inverted triangular shape widened toward the upper side with a part thereof touching a bottom corner of the front surface of the image forming unit housing 15 (front bottom end of the left frame plate 152) as a vertex and an upper edge 76*a* as a base. As a result of the presence of such a front inverted triangular wall 76, a front upper corner portion of the image forming unit housing 15 is obliquely cut when the housing 15 is viewed from front. The upper edge 76*a* is located at such a height position corresponding to that of the top surface of the housing 15.

The ceiling wall 714 is comprised of an upper ceiling wall 714*a* corresponding to the upper edge of the left wall 713, a lower ceiling wall 714*b* corresponding to the upper edge of the front inverted triangular wall 76 and a vertical wall 714*c* extending between the front edge of the upper ceiling wall 714*a* and the rear edge of the lower ceiling wall 714*b*. The ceiling wall 714 has such a stepped shape as to conform to the shapes of the mating parts (i.e. image reading unit housing 12 and image forming unit housing 15) on which the storage structure 70 is mounted.

In the covering body 71 thus formed, a storage section 73 is defined to store goods in this embodiment. The storage section 73 is formed by recessing a substantially central part of the left wall 713 toward the right side. The storage section 73 is formed by a space enclosed by a bottom plate 731 extending in forward and backward directions, a pair of front and rear side plates 732 having an inverted trapezoidal shape, a top plate 733 extending between the upper edges of the pair of side plates 732 and a back plate 734 extending between the right edges of these bottom plate 731, pair of side plates 732 and top plate 733. Since the left wall 713 is the wall surface extending along the virtual plane S as described above, the storage section 73 is formed in the space defined at the inner side of the virtual plane S.

A vent hole 153 is formed at a position of the left frame plate 152 of the image forming unit housing 15 corresponding to the fixing device 32, and a fan device 150 is mounted in this vent hole 153. A louver 74 is provided at a position of the left wall 713 of the covering body 71 corresponding to the fan device 150. Air after cooling the fixing device 32 is exhausted to the outside through the vent hole 153 and the louver 74 by driving the fan device 150.

A grip recess 75, into which a user can insert his or her fingers, is formed at an upper position in a central part of the left wall 713 in forward and backward directions. In this embodiment, the covering body 71' (see FIG. 2A) corresponding to the covering body 71 of the storage structure 70 and having an identical outer shape is provided at the right side of the image forming unit housing 15. Although neither the storage section 73 nor the louver 74 is provided in this covering body 71', a grip recess 75' corresponding to the grip recess 75 is formed.

The user's fingers are inserted into this pair of grip recesses 75, 75' upon lifting and transporting the image forming apparatus 10. Since this can prevent the image reading unit housing 12 from being directly lifted up, there is no likelihood of deforming the image reading unit housing 12 housing precision devices due to a load produced upon lifting the image reading unit housing 12 up. This can prevent the occurrence of such an inconvenience that an image reading process cannot be properly performed due to the misalignment of the precision devices.

A half moon-shaped cutout 761 is formed at an upper position of the front edge portion of the front inverted triangular wall 76. By this cutout 761, a part of the front edge portion of the front inverted triangular wall 76 and a part of the wall surface of the front inverted triangular wall 76 continuous with the front edge portion are cut out. The user inserts his or her finger into the cutout 761 upon opening or closing the front frame 80 of the image forming unit housing 15. It should be noted that the cutout 761 can also function as a vent hole.

The front inverted triangular wall 76 is also formed with three through holes 762 vertically aligned in series at the front edge portion. On the other hand, screw holes 154 are formed at the front edge portion of the left frame plate 152 of the image forming unit housing 15 at positions corresponding to the respective through holes 762. With the covering body 71 placed on the left frame plate 152, bolts 77 are inserted through the through holes 762 and screwed into the screw holes 154 of the left frame plate 152 via a hanging column 82 of the front frame 80. In this way, the covering body 71 is mounted on the image forming unit housing 15 via the front frame 80.

The covering body 71 is formed with through holes at specified positions in addition to the through holes 762 at the front edge portion of the front inverted triangular wall 76. Unillustrated bolts are screwed into screw holes formed at corresponding positions of the image forming unit housing 15 via these through holes.

The storage door 72 is openably and closably mounted on a left opening of the storage section 73 and includes a door main body 721 in the form of a flat plate and a U-shaped frame body 722. The door main body 721 has a rectangular shape in conformity with the rectangular opening of the storage section 73. The frame body 722 stands up from the front and rear edge portions and the left edge portion of the door main body 721 in FIG. 3.

The U-shape frame body 722 is comprised of a pair of front and rear side frame elements 722*a* and an end frame element 722*b* extending between this pair of side frame elements 722*a*. Screw shafts 723 penetrating the right ends of the respective side frame elements 722*a* are respectively screwed into screw holes 732*a* formed at the bottom ends of the respective side plates 732 of the storage section 73. Thus, the storage door 72 is mounted between the side plates 732 rotatably about the screw shafts 723 as shown in FIG. 4.

Instead of the screw shafts 723, a pair of cylindrical projections projecting in opposite directions may be provided at the base ends of the pair of side frame elements 722*a* of the storage door 72. This pair of cylindrical projections are fitted into supporting holes correspondingly formed in the storage section 73, whereby the storage door 72 is made rotatable about the cylindrical projections.

The end frame element 722*b* of the storage door 72 is formed with a pair of front and rear rectangular holes, and cylindrical pieces 724 are provided such that the outer circumferential surfaces thereof partly project outward through these rectangular holes. These cylindrical pieces 724 are biased in such a direction as to project outward through the rectangular holes of the end frame element 722*b* by unillustrated leaf springs.

On the other hand, locking holes 733*a*, into which the cylindrical pieces 724 are fittable, are formed in the top plate 733 of the storage section 73 at positions corresponding to the respective cylindrical pieces 724. The user rotates the storage door 72 in an opened state as shown in FIG. 4 in a clockwise direction about the screw shafts 723. When the respective cylindrical pieces 724 come to interfere with the left end portion of the top plate 733 by the rotation of the storage door 72, they are temporarily retracted into the rectangular holes against biasing forces of the leaf springs and, then, project at the positions of the locking holes 733*a* to be fitted into the locking holes 733*a*. In this way, the storage door 72 is stably kept in a closed state.

An operation recess 713*a* is formed at a center position of the top plate 733 in forward and backward directions by cutting the left wall 713 upward. Upon opening the storage door 72 in the closed state (see FIG. 1), the user may insert his or her fingers into this operation recess 713*a* and pull the end frame element 722*b* leftward. In this way, the storage door 72 is rotated in a counterclockwise direction about the screw shafts 723 to be opened as shown in FIG. 4.

A slip stopper 725 is formed on a part of the end frame element 722*b* corresponding to the operation recess 713*a*. The user can easily open the storage door 72 by pressing this slip stopper 725 with his or her fingers.

Since the storage structure 70 is constructed as above, various goods can be stored, utilizing the space of the storage section 73. For example, an instruction manual of the image forming apparatus 10, a cleaning cloth, repair tools and the like can be stored. Further, the storage section 73 does not project from the side surface of the image forming apparatus 10 and is formed, utilizing a lateral dimension difference between the image reading unit housing 12 and the image forming unit housing 15. Therefore, the storage section 73 does not increase a spatial area taken up by the image forming apparatus 10.

Next, the front frame 80 (second cover) detachably mounted on the front surface of the image forming unit housing 15 is described with reference to FIG. 5 and, if necessary, FIGS. 1 to 4. In FIG. 5, an open state of the manual feed tray 61 is shown by solid line and a closed state thereof is shown by chain double-dashed line.

The front frame 80 includes an upper beam 81, a pair of left and right hanging columns 82 and a pair of left and right extending plate pieces 83. The upper beam 81 is mounted in close contact with an upper front edge portion of the image forming unit housing 15 and has an L-shaped cross section. The hanging columns 82 are members hanging down from the respective left and right ends of the upper beam 81 and mounted on left and right vertical edge plates 155 of the image forming unit housing 15. The extending plate pieces 83 are members extending backward from the left and right ends of the upper beam 81 while widening the spacing therebetween and placed on left and right horizontal edge plates 156 (cut oblique edge portions) at a front upper part of the image forming unit housing 15. The manual feed tray 61 is provided between the pair of hanging columns 82.

A C-shaped frame 157 (see FIG. 3) in a state where the outer surfaces made of L-shaped section steel face in vertical and forward direction is provided on the front upper edge portion of the image forming unit housing 15. The upper beam 81 is held in close contact with this C-shaped frame 157 with inner surfaces thereof faced downward and backward.

The respective hanging columns 82 include front columns 821 hanging down from the front surface of the upper beam 82 while being flush therewith, and right-angle columns 822 extending backward at right angles from edges of these front columns 821 facing each other and also vertically extending. Each right-angle column 822 is formed with through holes 823 corresponding to the through holes 762 of the front inverted triangular wall 76.

With the front frame 80 pressed against the front surface of the image forming unit housing 15 and with the covering body 71 pressed against the left frame plate 152, the bolts 77 are inserted through the through holes 762 of the front inverted triangular wall 76 and the through holes 823 of the right-angle column 822 of the front frame 80, and screwed and tightened into the screw holes 154 of the left frame plate 152. By this tightening, the covering body 71 and the front frame 80 are mounted on the image forming unit housing 15 as shown in FIG. 4. The covering body 71 is mounted on the image forming unit housing 15 not only via these through holes 762, 823, but also via other through holes formed at specified positions. This is not described here.

Upon detaching the front frame 80 once mounted on the image forming unit housing 15 for a maintenance operation in the image forming apparatus 10 or the like, the user may insert his or her fingers into the half moon-shaped cutouts 761 of the front inverted triangular walls 76 and pull the right-angle columns 822 of the front frame 80 forward after detaching the bolts 77. By doing so, the front frame 80 can be easily detached from the image forming unit housing 15.

Figure 6:
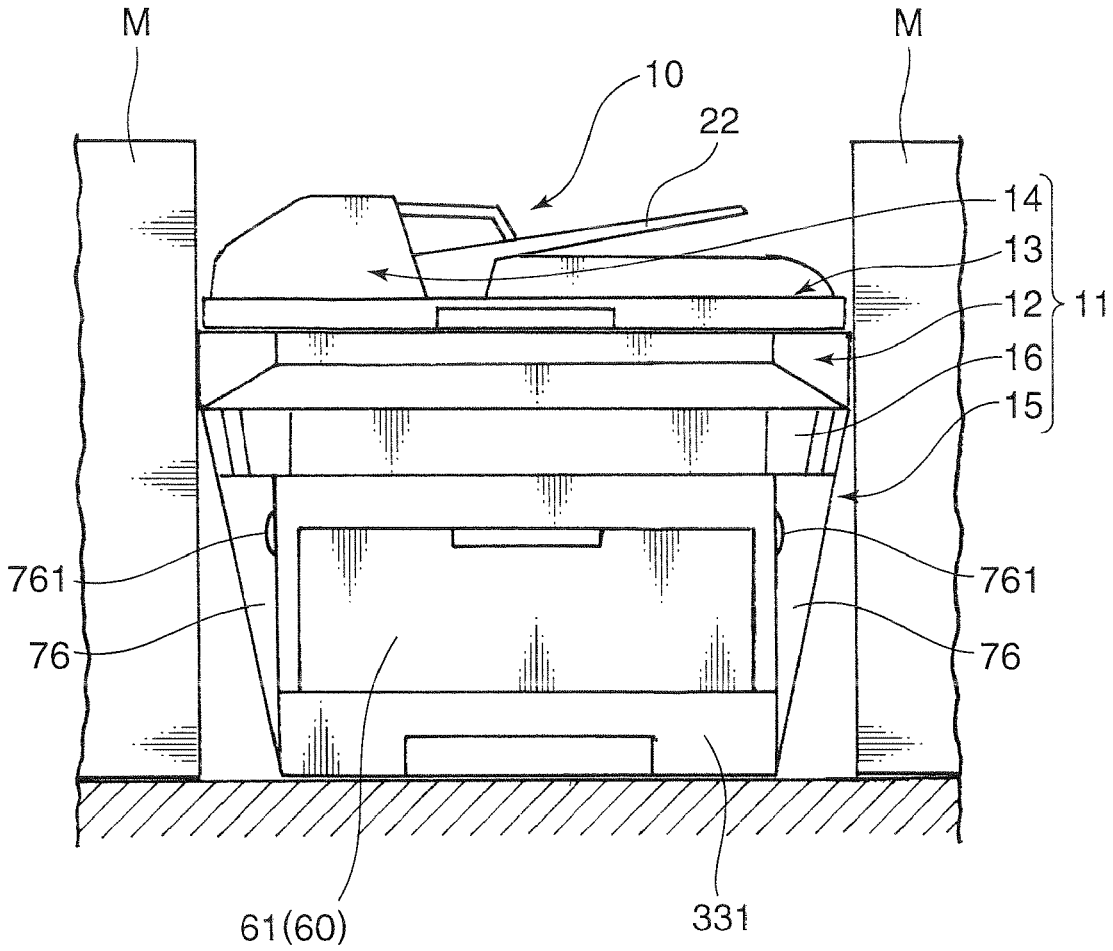
FIG. 6 is a front view showing a state where the image forming apparatus is installed between other apparatuses.

FIG. 6 is a front view showing an actually installed state of the image forming apparatus 10. Here, the image forming apparatus 10 is illustrated to be installed between other apparatuses M. Even in such an installed state, the cutouts 761 are located at the front edge portions of the front inverted triangular walls 76 and are distanced from the adjacent other apparatuses M, wherefore fingers can be inserted into the half moon-shaped cutouts 761 without being interfered by the other apparatuses M. Therefore, the user can easily detach the front frame 80 from the image forming unit housing 15 without moving the image forming apparatus 10.

FIG. 5 illustrates the front frame 80 to be detached (opened and closed) using the bolts 77. Instead of such a front frame 80, a front cover 90 which can be easily opened and closed without using any bolt by being rotated can be applied to the image forming apparatus 10.

Figure 7A:
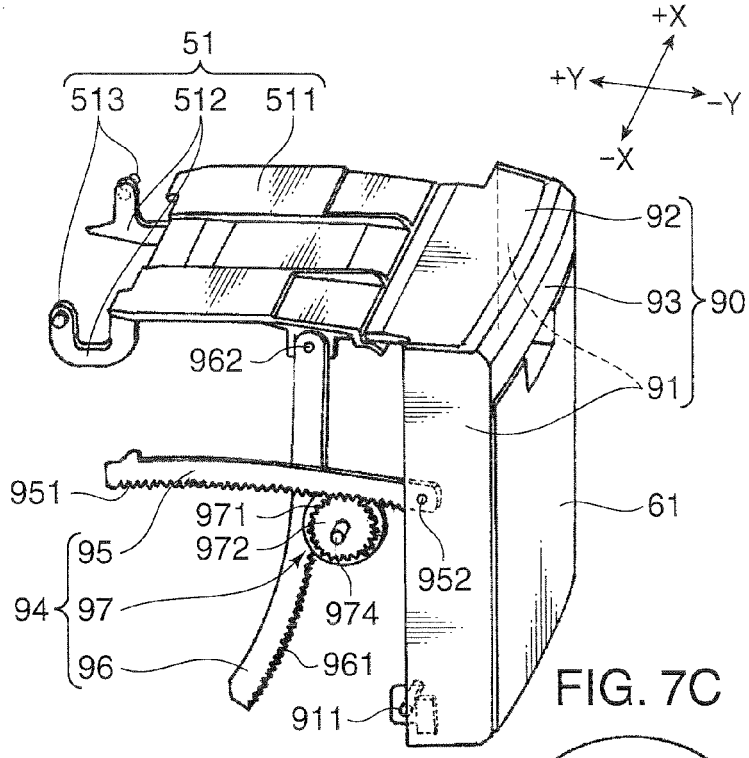
Figure 7C:
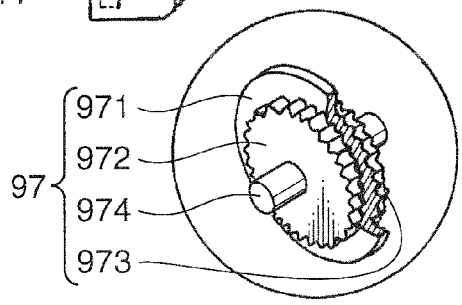
Figure 7B:
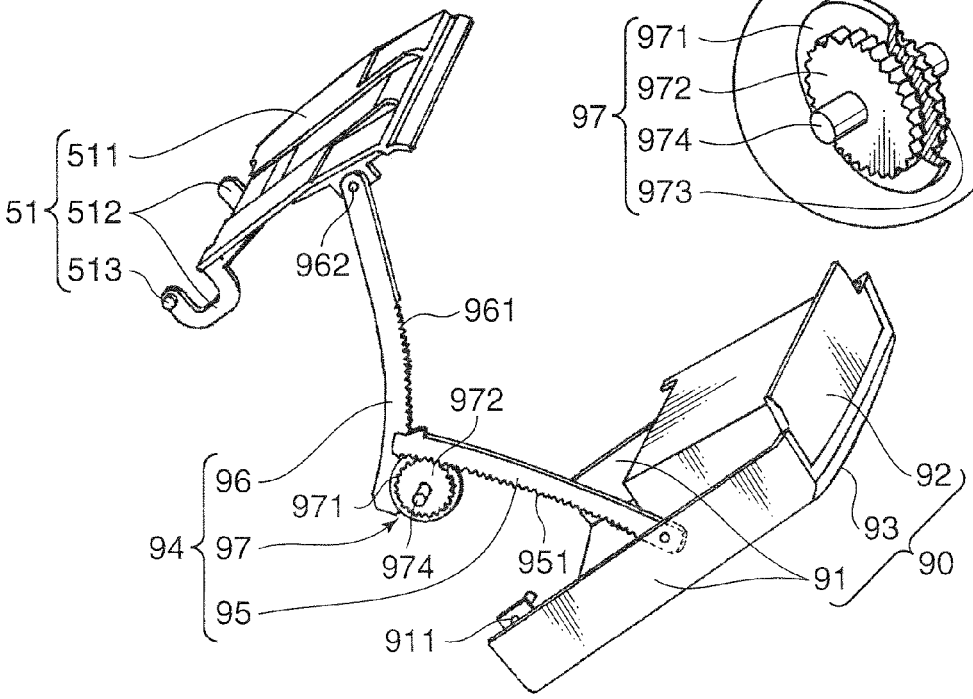

An example of such a front cover 90 (second cover) is described below with reference to FIGS. 7A to 7C. FIGS. 7A and 7B are perspective views showing one embodiment of the front cover 90, wherein FIG. 7A shows a state where the discharge tray 51 and the front cover 90 are closed and FIG. 7B shows a state where the discharge tray 51 and the front cover 90 are opened. FIG. 7C is a perspective view partly cut away showing a dual gear 97. The indication of directions by X and Y in FIGS. 7A to 7C are the same as in the case shown in FIGS. 1A and 1B (X-X are lateral directions (−X: leftward direction, +X: rightward direction) and Y-Y are forward and backward directions (−Y: forward direction, +Y: backward direction).

The front cover 90 includes a pair of left and right vertically extending side frames 91, a top frame 92 extending between the upper edges of this pair of side frames 91 and a front frame 93 hanging down a specified distance from the front edge of the top frame 92. In a space enclosed by this pair of side frames 91, the top frame 92 and the front frame 93, the manual feed tray 61 is supported rotatably about an unillustrated shaft extending between the side frames 91.

The bottom ends of the side frames 91 are supported rotatably about a frame shaft 911 supported on an unillustrated housing frame of the image forming unit housing 15. Thus, the front cover 90 is displaceable between a closing posture shown in FIG. 7A and an exposing posture shown in FIG. 7B.

The outer sides of the respective side frames 91 are covered by the covering bodies 71, 71' described above. Accordingly, with the front cover 90 closed with respect to the image forming unit housing 15, parts of the outer side surfaces of the side frames 91 are exposed through the half moon-shaped cutout 761 (see FIG. 4).

The discharge tray 51 includes a tray main body 511 whose front end is set at the same level as the top frame 92 of the front cover 90, a pair of left and right U-shaped brackets 512 projecting backward from the opposite lateral ends of the rear end of the tray main body 511 and a pair of tray shafts 513 projecting in opposite directions from the respective brackets 512.

The discharge tray 51 is rotatable in forward and reverse directions about the tray shafts 513 supported at specified positions of the unillustrated housing frame of the image forming unit housing 15. Thus, the discharge tray 51 is displaceable between a horizontal posture shown in FIG. 7A and an oblique posture shown in FIG. 7B.

Such discharge tray 51 and front cover 90 are connected to each other via a synchronous opening/closing mechanism 94. The synchronous opening/closing mechanism 94 includes a front cover-side rack 95 projecting backward from a substantially vertical central part of the left side frame 91, a tray-side rack 96 hanging down from a front part of the left edge of the tray main body 511 so as to be able to intersect with the front cover-side rack 95, and the dual gear 97 arranged in engagement with both the tray-side rack 96 and the front cover-side rack 95 at an intersection of these.

The front cover-side rack 95 has rack teeth 951 on the lower edge thereof. The front cover-side rack 95 is supported rotatably about a first shaft 952 projecting inward toward a substantially central part of the left side frame 91. An edge surface of the front cover-side rack 95 where the rack teeth 951 are arranged is an arcuate surface slightly concave toward a lower side.

The tray-side rack 96 has rack teeth 961 arranged on the front edge thereof. The tray-side rack 96 is supported rotatably about a second shaft 962 projecting outward (leftward) from a front position of the left edge of the tray main body 511. An edge surface of the tray-side rack 96 where the rack teeth 961 are arranged is an arcuate surface slightly convex toward a front-lower side.

The dual gear 97 is arranged at a position below the front cover-side rack 95 and at the front side of the tray-side rack 96 near the intersection of the front cover-side rack 95 and the tray-side rack 96. As shown in a circle of FIG. 7C, the dual gear 97 includes a partition disk 971, a first gear 972, a second gear 973 and a gear shaft 974.

The first gear 972 is so concentrically placed on the left side of the partition disk 971 as to be integrally rotatable and is engaged with the rack teeth 951 of the front cover-side rack 95. The second gear 973 is so concentrically placed on the right side of the partition disk 971 as to be integrally rotatable and is engaged with the rack teeth 961 of the tray-side rack 96. The gear shaft 974 penetrates through these partition disk 971, first gear 972 and second gear 973 at the central positions thereof in such a manner as to be integrally rotatable.

The diameters of the first and second gears 972, 973 are set smaller than that of the partition disk 971. Accordingly, with the front cover-side rack 95 engaged with the first gear 972 and the tray-side rack 96 engaged with the second gear 973, the respective racks 95, 96 do not interfere with each other by being partitioned by the partition disk 971.

According to the synchronous opening/closing mechanism 94 thus constructed, upon displacing the front cover 90 from the closing posture to the exposing posture, the user may insert his or her fingers into the half moon-shaped cutouts 761 (FIG. 4) to pull the front cover 90 forward. By this pulling operation, this front cover 90 is rotated in a clockwise direction in FIG. 7A about the frame shaft 911. Thus, the front cover-side rack 95 moves forward while being rotated counterclockwise about the first shaft 952, wherefore the first gear 972 engaged with the rack teeth 951 of the front cover-side rack 95 is rotated clockwise about the gear shaft 974.

By this rotation of the first gear 972, the second gear 973 integral to the first gear 972 is also rotated clockwise. In this way, the tray-side rack 96 having the rack teeth 961 engaged with the second gear 973 moves upward. Accordingly, the tray main body 511 is pushed upward via the second shaft 962 and rotated counterclockwise about the tray shafts 513.

With the front cover 90 displaced to the exposing posture, the discharge tray 51 is also displaced from the horizontal posture to the oblique posture. Thus, an opening facing upward toward the front is formed at an upper corner of the front surface of the image forming unit housing 15 as shown in FIG. 7B, wherefore the user can easily perform a maintenance operation via this opening.

As described in detail above, according to the image forming apparatus 10 of this embodiment, the lateral dimension of the image reading unit housing 12 is set larger than that of the image forming unit housing 15. The left wall 713 of the covering body 71 is arranged along the virtual plane S connecting the first bottom edge 122 of the image reading unit housing 12 and the second bottom edge 151 of the image forming unit housing 15.

Since the left wall 713 of such a covering body 71 is an oblique surface, even if the image forming apparatus 10 is arranged as in FIG. 6 or along a wall surface of an office, a clearance is formed between the other apparatus M or the wall surface and the covering body 71. Accordingly, the user can easily move the image forming apparatus 10 by inserting his or her hand into this clearance. Alternatively, the user can easily pull the image forming apparatus out from the space between adjacent apparatuses by holding the front inverted triangular walls 76 between both hands to move the image forming apparatus forward or by gradually moving the image forming apparatus forward while repeatedly swinging the apparatus main body to left and right with his or her palms pressed against the both front inverted triangular walls 76.

The left wall 713 is formed with the storage section 73 for storing goods. The recessed space at the inner side of the virtual plane S originally having no utility is utilized for such a storage section 73. Thus, the storage section 73 can be formed without increasing the volume of the image forming apparatus, specifically without providing any projecting part from the image forming apparatus for storage purpose. Such a storage section 73 is convenient since various goods such as the instruction manual of the image forming apparatus 10 and tools can be stored. For example, in the case of storing the instruction manual of the image forming apparatus in the storage section 73, the user can quickly deal with a situation by saving trouble to search for the instruction manual and to fetch it every time the instruction manual is necessary, wherefore various office functions can be speeded up.

Further, the covering body 71 having the left wall 713 extending along the virtual plane S is mounted on the side surface of the image forming apparatus 10 and the storage space of the storage section 73 is formed inside the covering body 71. Thus, the goods stored in the storage section 73 are concealed by the covering body 71, whereby the external appearance of the image forming apparatus 10 does not look awful and the image forming apparatus 10 can have a beautiful design.

Since the grip recesses 75, 75' are formed in the covering bodies 71, 71', it can be prevented that the user lifts the image forming apparatus 10 up by placing his or her hands near the bottom edges 122 of the image reading unit housing 12 upon carrying the image forming apparatus 10 around. This can prevent the deformation of the image reading unit housing 12 housing precision devices due to a lifting load.

In addition, the covering body 71 is provided with the openable and closable storage door 72. The user can take goods into and out of the storage section 73 by opening the storage door 72 and can prevent the goods from coming out from the storage section 73 by closing the storage door 72.

The present invention is not limited to the above embodiment and also embraces the following contents.

(1) In the above embodiment, the image forming apparatus 10 is described, taking a copier as an example. The image forming apparatus may be a printer or a facsimile machine. Further, the image forming apparatus may be for black and white printing or for color printing. Furthermore, the image forming apparatus may be a so-called complex machine (MFP) provided with various functions of a copier, a printer and a facsimile machine.

(2) In the above embodiment, the conveying direction of the document P1 in the document reading unit 20 and that of the sheet P in the image forming unit 30 are set orthogonal to each other. Instead, the conveying direction of the document P1 in the document reading unit 20 and that of the sheet P in the image forming unit 30 may be set to be the same direction.

(3) Although the storage section 73 is provided only in the left covering body 71 in the above embodiment, it may be also provided in the right covering body 71'.

(4) In the above embodiment, a rear part of the image reading unit housing 12 may project from the image forming unit housing 15. In this case, a storage section similar to the above can be formed also in a back-side space.

The above specified embodiment mainly embraces inventions having the following constructions.

An image forming apparatus according to one aspect of the present invention comprises a first main body housing an image reading unit for reading image information of a document; a second main body arranged below the first main body and housing an image forming unit for performing a specified image forming process based on the image information read by the image reading unit; and a first cover mounted on at least one side surface of the second main body, wherein the lateral width of the first main body is set larger than that of the second main body; the first cover includes a first wall surface and a second wall surface; the first wall surface is a wall surface extending along a virtual plane connecting a first edge extending in forward and backward directions at one lateral end of the first main body and a second edge extending in forward and backward directions at one lateral end of the second main body corresponding to the first edge and located at a bottom part of the second main body; and the second wall surface is a wall surface for closing a substantially inverted triangular opening formed between the front edge of the first wall surface and the side surface of the second main body and including an inclined surface portion obliquely extending from the front edge of the first wall surface toward the side surface of the second main body.

According to this construction, a user can easily pull the image forming apparatus out from a space between adjacent apparatuses by holding the inclined surface portion of the second wall surface between his or her hands to move the image forming apparatus forward or by gradually moving the image forming apparatus forward while repeatedly swinging the image forming apparatus to left and right with his or her palms pressed against the first wall surfaces. Thus, operability can be improved when it is necessary to pull the image forming apparatus out from the space between the adjacent apparatuses upon the relocation of the image forming apparatus by the user or upon a maintenance operation by a service person.

In the above construction, it is preferable that a second cover openably and closably mounted on the front surface of the second main body is further provided; that the first cover is mounted on each of the left and right surfaces of the second main body; and that the second cover is arranged between the left and right second wall surfaces.

According to this construction, since the first covers have the first and second wall surfaces, the user can easily open and close or detach the second cover even if the image forming apparatus is arranged between adjacent apparatuses.

In the above construction, the inclined surface portion has a substantially inverted triangular shape widened toward the upper side with a part thereof touching a bottom corner of the front surface of the second main body as a vertex. According to this construction, the inclined surface portion can have better operability.

In the above construction, it is preferable that each inclined surface portion is formed with a cutout by cutting a part of the front edge of the inclined surface portion and a part of the inclined surface portion continuous therewith backward; and that side surfaces of the second cover are exposed through the cutouts. In this case, the second cover is preferably rotatable about the bottom end thereof as a rotation supporting point.

According to this construction, the user can easily perform opening and closing operations to pull or rotate the second cover, for example, by placing his or her fingers on the side surfaces of the second covers through the cutouts.

In the above construction, it is preferable to further comprise a storage section arranged in a space between the first wall surface of the first cover and the side surface of the second main body and capable of storing specified goods.

According to this construction, the storage section does not project from the image forming apparatus since being formed in the space formed at the inner side of the first wall surface (virtual plane) of the first cover. Accordingly, a storage space for various goods can be ensured without increasing the volume of the image forming apparatus. In the case of storing an instruction manual of the image forming apparatus in the storage section, the user can quickly deal with a situation by saving trouble to search for the instruction manual and to fetch it every time the instruction manual is necessary. Therefore, various office functions using the image forming apparatus can be speeded up.

In this case, the storage section preferably includes a storage space formed by recessing a part of the first wall surface toward the side surface of the second main body.

In the above construction, it is preferable that an openable and closable door constituting a part of the first wall surface is further provided; and that a storage space of the storage section is formed at an inner side of the door. According to this construction, since the goods stored in the storage section are concealed by the door, the external appearance of the image forming apparatus does not look awful and the image forming apparatus can have a beautiful design.

Further, it is preferable that an openable and closable door for covering an opening of a recessed part of the first wall surface is further provided; that the opening of the recessed part is rectangular; that the door includes a plate member having a shape in conformity with the rectangular opening; and that the door is rotated about the bottom end thereof as a rotation supporting point upon being opened and closed.

According to this construction, goods can be taken into and out of the storage section by opening the door while being prevented from coming out of the storage section by closing the door.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

This application is based on Japanese Patent Application Nos. 2007-318261 and 2007-318263 filed on Dec. 10, 2007, respectively, the contents of which are hereby incorporated by reference.

What is claimed is:

1. An image forming apparatus, comprising:

a first main body having a front with an operation unit housing user controls, a rear and left and right side surfaces defining a lateral width, the first main body housing an image reading unit for reading image information of a document;

a second main body arranged below the first main body and having a front, a rear and left and right side surfaces defining a lateral width that is less than the lateral width of the first main body, the second main body housing an image forming unit for performing a specified image forming process based on the image information read by the image reading unit;

a side cover mounted on at least one of the side surfaces of the second main body, the side cover including a first wall surface and a second wall surface, the first wall surface extending along a plane connecting a first edge extending in forward and backward directions at one of the side surfaces of the first main body and a second edge extending in forward and backward directions at a bottom part of the second main body the second wall surface closing a substantially inverted triangular opening formed between a front edge of the first wall surface and the respective side surface of the second main body and including an inclined surface portion obliquely extending from the front edge of the first wall surface toward the respective front side surface of the second main body.

2. An image forming apparatus according to claim 1, further comprising:

a front cover openably and closably mounted on the front of the second main body;

the side cover is mounted on each of the left and right surfaces of the second main body; and the front cover is arranged between the left and right second wall surfaces.

3. An image forming apparatus according to claim 2, wherein:

each inclined surface portion is formed with a cutout adjacent a front edge of the respective inclined surface portion; and side surfaces of the front cover are exposed through the cutouts.

4. An image forming apparatus according to claim 3, wherein the front cover is rotated about a bottom end thereof as a rotation supporting point.

5. An image forming apparatus according to claim 1, further comprising a storage section arranged in a space between the first wall surface of the side cover and the side surface of the second main body.

6. An image forming apparatus according to claim 5, wherein the storage section includes a storage space formed by recessing a part of the first wall surface toward the side surface of the second main body.

7. An image forming apparatus according to claim 6, further comprising an openable and closable door for covering an opening of a recessed part of the first wall surface, wherein:

the opening of the recessed part is rectangular;

the door includes a plate member having a shape in conformity with the rectangular opening; and the door is rotated about a bottom end thereof as a rotation supporting point upon being opened and closed.

8. An image forming apparatus, comprising:

a first main body having a front, a rear and left and right side surfaces defining a lateral width, the first main body housing an image reading unit for reading image information of a document;

a second main body arranged below the first main body and having a front, a rear and left and right side surfaces defining a lateral width that is less than the lateral width of the first main body, the second main body housing an image forming unit for performing a specified image forming process based on the image information read by the image reading unit; and a side cover mounted on at least one of the side surface of the second main body, the side cover including first and second wall surfaces, the first wall surface extending along a plane connecting a first edge extending in forward and backward directions at one of the side surfaces of the first main body and a second edge extending in forward and backward directions at a bottom part of the second main body, the second wall surface closing a substantially inverted triangular opening formed between a front edge of the first wall surface and the respective side surface of the second main body and including an inclined surface portion obliquely extending from the front edge of the first wall surface toward the respective side surface of the second main body, the inclined surface portion having a substantially inverted triangular shape widened toward an upper side with a part thereof touching a bottom corner of the front of the second main body as a vertex.

9. An image forming apparatus comprising:

a first main body having a front, a rear and left and right side surfaces defining a lateral width, the first main body housing an image reading unit for reading image information of a document;

a second main body arranged below the first main body and having a front, a rear and left and right side surfaces defining a lateral width that is less than the lateral width of the first main body, the second main body housing an image forming unit for performing a specified image forming process based on the image information read by the image reading unit;

a side cover mounted on at least one of the side surfaces of the second main body, the side cover including first and second wall surfaces, the first wall surface extending along a plane connecting a first edge extending in forward and backward directions at one of the side surfaces of the first main body and a second edge extending in forward and backward directions at a bottom part of the second main body, the second wall surface closing a substantially inverted triangular opening formed between the front edge of the first wall surface and a corresponding one of the side surfaces of the second main body and including an inclined surface portion obliquely extending from a front edge of the first wall surface toward the side surface of the second main body;

a storage section arranged in a space between the first wall surface of the first cover and the side surface of the second main body; and an openable and closable door constituting a part of the first wall surface wherein a storage space of the storage section is formed at an inner side of the door.

* * * * *